US007611420B1

(12) United States Patent
Turner

(10) Patent No.: US 7,611,420 B1
(45) Date of Patent: Nov. 3, 2009

(54) GOLF SWING TRAINING GUIDE

(76) Inventor: William C. Turner, 202 Island Cir., Sarasota, FL (US) 34242

( * ) Notice: Subject to any disclaimer, the term of this patent is extended or adjusted under 35 U.S.C. 154(b) by 0 days.

(21) Appl. No.: 12/008,575

(22) Filed: Jan. 11, 2008

(51) Int. Cl.
*A63B 69/36* (2006.01)

(52) U.S. Cl. ..... 473/259; 473/257; 473/258

(58) Field of Classification Search ..... 473/226, 473/229, 257, 259, 260, 261, 264, 265, 219, 473/258
See application file for complete search history.

(56) References Cited

U.S. PATENT DOCUMENTS

| | | | | |
|---|---|---|---|---|
| 1,567,530 | A | 12/1925 | Macnaughton et al. | |
| 1,944,942 | A * | 1/1934 | MaCdonald | 473/259 |
| 2,756,056 | A * | 7/1956 | Zega | 473/259 |
| 2,868,543 | A | 1/1959 | Zega | |
| 3,341,208 | A | 9/1967 | Marcella | |
| 3,489,416 | A | 1/1970 | Mark | |
| 3,583,707 | A | 6/1971 | Fujimoto | |
| 3,711,103 | A | 1/1973 | Seltzer | |
| 4,949,974 | A | 8/1990 | Bellagamba | |
| 5,429,367 | A | 7/1995 | Amos | |
| 5,441,275 | A | 8/1995 | Yoshishita | |
| 5,467,993 | A | 11/1995 | Higginson | |
| 5,595,545 | A | 1/1997 | O'Brien | |
| 5,816,932 | A | 10/1998 | Alexander | |
| 5,895,327 | A | 4/1999 | Francisco | |
| 5,984,798 | A | 11/1999 | Gilmour | |
| 6,273,826 | B1 | 8/2001 | Bauer | |
| 6,364,786 | B1 | 4/2002 | Khano | |
| 7,144,340 | B1 | 12/2006 | Jones et al. | |
| 7,238,116 | B1 | 7/2007 | Sulzener | |
| 2005/0096145 | A1 * | 5/2005 | Barretto | 473/257 |

* cited by examiner

*Primary Examiner*—Nini Legesse
(74) *Attorney, Agent, or Firm*—Charles J. Prescott

(57) ABSTRACT

A golf swing training apparatus including a golf club guide and a generally U-shaped support frame having spaced apart front and rear frame members connected together by a base frame member. The support frame is adjustably inclined to the ground or a working support surface at the lie angle of the golf club by a support arm. The golf club guide is positioned between the frame members and includes closely spaced apart front and rear guide ring segments which define a substantially planar circular shaped golf club swing slot therebetween, the swing slot having an unobstructed preferably adjustable width adapted for free swing a golf club therewithin. The front guide ring segment is attached to and is supported by the front frame members while the rear guide ring segment is attached to and is supported by the rear frame member.

10 Claims, 11 Drawing Sheets

GOLF SWING TRAINING GUIDE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to golf training devices, and more particularly to a golf swing training apparatus which forces the free swing of a golf club into an inclined plane for more proper repetitious swing practice.

2. Description of Related Art

A great deal of inventiveness and productivity has been directed to improving the rather unnatural golf swing of a golfer. Because the golf swing is so unnatural, to achieve a proper and consistent golf swing for more accurate golf play, a golfer must ingrain the mental image and movement of a golf club to fall within an inclined plane generally equal in inclination to the lie of the golf club being used. The only way to accomplish this is by repetitious consistent practice of a proper swing both in backstroke, down stroke and follow-thru.

A number of prior art devices which have been patented which are intended to accomplish this essential learning technique. U.S. Pat. No. 3,711,103 to Seltzer teaches a golf club swing guide including track members for guiding the golf club through a grooved swing, the support being adjustable in inclination. Newly issued U.S. Pat. No. 7,238,116 to Sulzener discloses a golf swing training apparatus with adjustable feet, telescopically adjustable A-frames and a hinged guide ring.

A golf club swing training device is disclosed in U.S. Pat. No. 5,816,932 to Alexander including framework having a forward ring member, the device being adjustable as to elevation and angle of plane. Amos teaches an adjustable golf swing practice device in U.S. Pat. No. 5,429,367 and Yoshishita discloses a golf swing training device being pivotable and having a swing path guide loop in U.S. Pat. No. 5,441,275.

Higginson teaches a golf swing training device including a guide track which is pivotally adjustably mounted on height adjustable side supports in U.S. Pat. No. 5,467,993. A very complicated device complete with sensors and computer microprocessor is disclosed by Gilmour in U.S. Pat. No. 5,984,798.

U.S. Pat. No. 5,895,327 to Francisco discloses a golf swing aid which constrains the swing of a golf club and Khano teaches a golf swing device with the golf club shaft affixed to the guide shaft in U.S. Pat. No. 6,364,786. Bellagamba teaches a golf club swing guide which is adjustable in U.S. Pat. No. 4,949,974 and Bauer discloses a golf swing training apparatus having a club guide ring in U.S. Pat. No. 6,273,826.

Earlier patents teaching golf swing devices include U.S. Pat. No. 1,567,530 to Macnaughton, et al., U.S. Pat. No. 2,868,543 to Zega, U.S. Pat. No. 3,341,208 to Marcella, U.S. Pat. No. 3,583,707 to Fujimoto and U.S. Pat. No. 3,489,416 to Mark.

U.S. Pat. No. 7,144,340 to Jones, et al. teaches a golf swing training device and method of use including a first and second rail with a carriage system slidably attached thereto. O'Brien teaches a golf swing training apparatus having circular track hoop made of light weight metal in U.S. Pat. No. 5,595,545.

The present invention provides a still further improvement in a golf swing training apparatus which controls the inclined planar movement of a golf club during the entire golf swing sequence without the use of a track or mechanical connection with the shaft of the golf club while still insuring that the golf club swing consistently lies within the desired inclined swing plane.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a golf swing training apparatus including a golf club guide and a generally U-shaped support frame having spaced apart front and rear frame members connected together by a base frame member. The support frame is adjustably inclined to the ground or a working support surface at the lie angle of the golf club by a support arm. The golf club guide is positioned between the frame members and includes closely spaced apart front and rear guide ring segments which define a substantially planar circular shaped golf club swing slot therebetween, the swing slot having an unobstructed preferably adjustable width adapted to freely swing a golf club therewithin. The front guide ring segment is attached to and is supported by the front frame members while the rear guide ring segment is attached to and is supported by the rear frame member.

It is therefore an object of this invention to provide a golf swing training apparatus which facilitates repeated consistent golf swing practice to engrain the feel of a proper swing into the memory of a golfer.

Yet another object of this invention is to provide a golf swing training apparatus which is easily adjustable to accommodate the height of the golfer and lie of the head of any particular golf club.

Still another object of this invention is to provide a golf swing training apparatus which guides the swing of the golf club in a desired narrow swing plane without restricting its free swing movement.

Another object of this invention is to provide a golf swing training apparatus with a variable width swing slot which is adjustable in accordance with the skill of the golfer.

And yet another object of this invention is to provide a golf swing training apparatus which is enlargeable in size to accommodate taller golfers.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
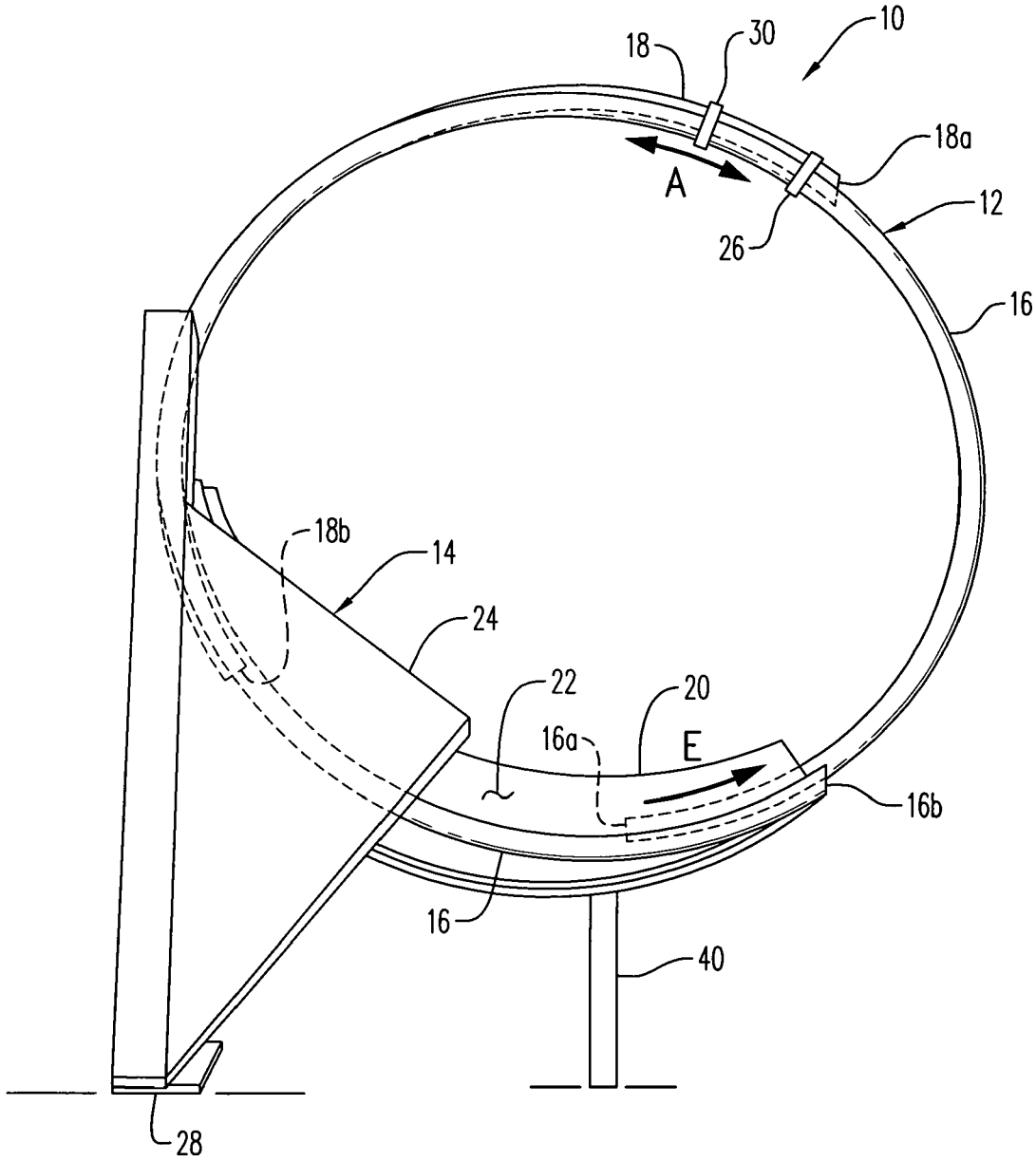
FIG. 1 is a front elevation view of one embodiment of the invention.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, and firstly to FIGS. 1 to 4, one embodiment of the invention is there shown generally at numeral 10 and includes a golf club guide assembly 12 and a generally U-shaped support frame 14. The golf club guide assembly 12 includes a front guide ring segment 16 and a rear guide ring segment 18, each of which is formed preferably of thin walled 1½" i.d. somewhat flexible PVC tubing. The front guide ring segment 16 is supported on a front frame member 24 of the support frame assembly 14 by a series of front guide ring holders 36 which support and interconnect the front guide ring segment 16. A center support 40 carries the majority of the weight of the golf club guide assembly 12.

Figure 4:
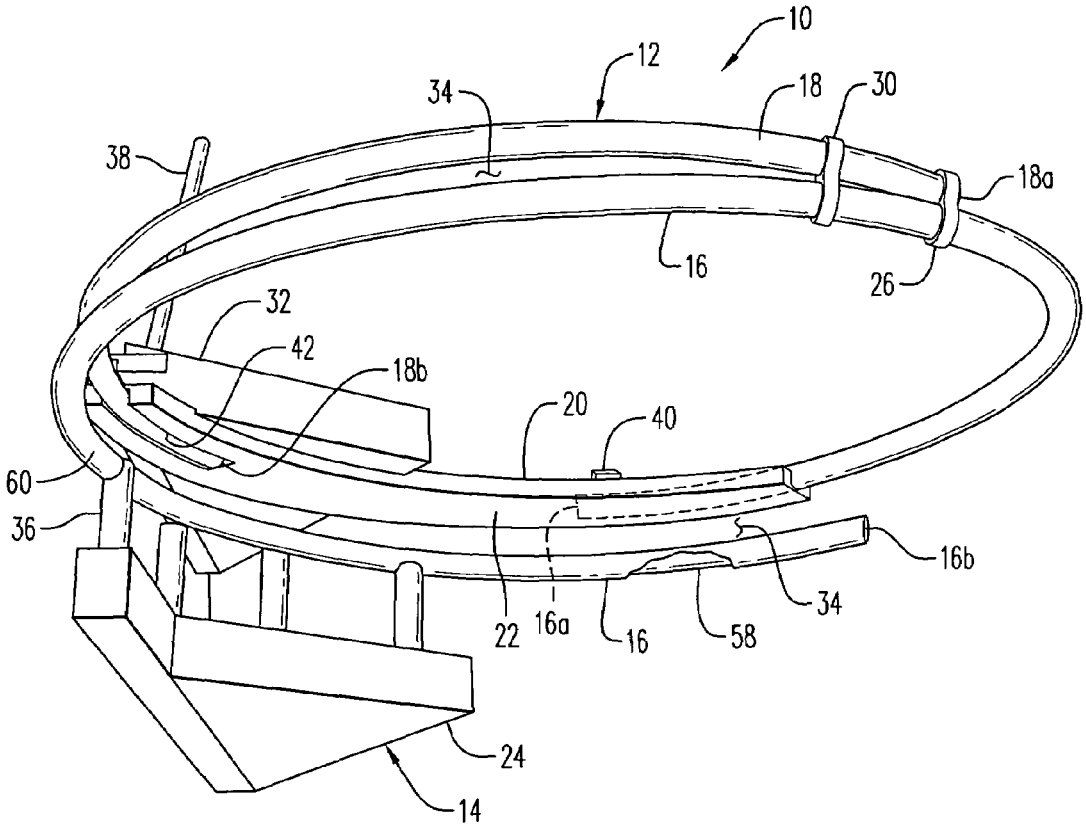
FIG. 4 is an upper perspective view of FIG. 1.

The rear guide ring segment 18 is supported at a proximal end 18*b* within a pocket 42, best seen in FIG. 4, formed into an upper end of a flat, planar club shaft guide 20 which itself is connected to a back frame member 32 of the support frame assembly 14. The front and rear back frame members 24 and 32 are rigidly connected together by a base frame member 28 preferably at an inclined angle so as to establish the plane of the golf shaft guide 20 at an inclined angle D generally equal to the lie angle of the golf club being used. This inclination is described more fully with respect to FIG. 6 herebelow.

Figure 2:
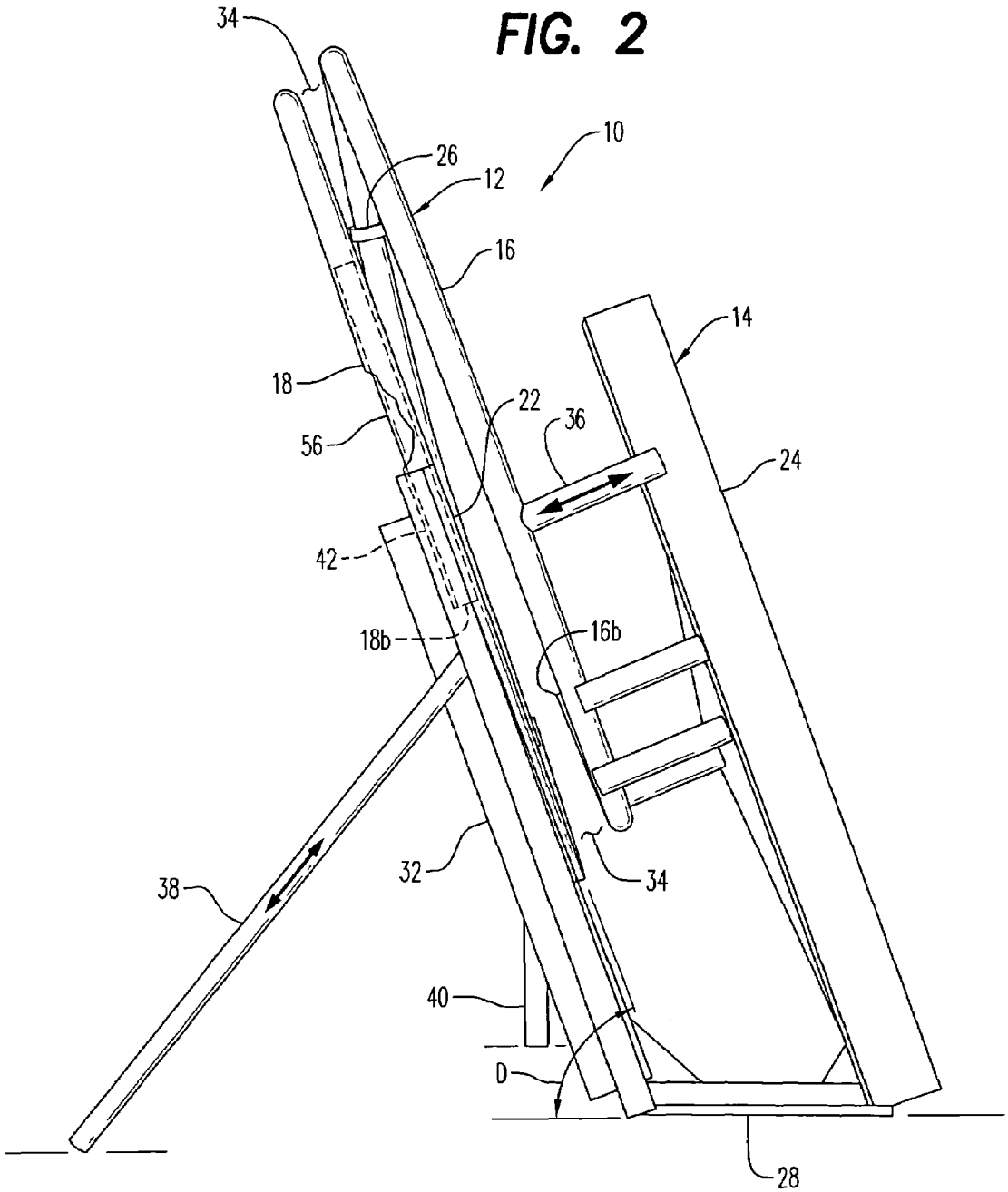
FIG. 2 is a right side elevation view of FIG. 1.

The golf club guide assembly 12 defines an inclined narrow swing slot 34 between the front and rear guide ring segments 16 and 18 as best seen in FIG. 2. This swing slot 34 is adjustable in width by the adjustment of the length of the front guide ring holders 36 while the lie angle D is adjusted for the club selection by varying the length of a support arm 38 connected at an upper end thereof to the back side of the back frame member 32 and bearing against the ground or other support surface at the other end thereof. Thus, the support frame assembly 14 being supported primarily on the base frame member 28 atop the ground or other support surface is tiltable at various inclined angles to establish the angle D of the planar surface 22 of the golf swing guide 20 within a lie angle range of between about 50° and 64°, the typical range of club lie angles commercially available.

The front guide ring segment 16, again primarily being supported by the front guide ring holders 36, extends from its distal end 16*b* through a little more than 360° to be supported within a pocket formed into the lower end portion of the planar club shaft guide 20 terminating at the proximal end 16*a*. The upper distal end 18*a* of the rear guide ring segment 18 is interconnected to the front guide ring segment 16 by a fixed connector 26. Thus, the swing slot 34 extends from a maximum back swing position of a golf club at 18*a* and the fixed connector 26 to the distal end 16*b* of the front guide ring segment 16, the swing slot 34 being completely smooth, clear and unobstructed.

Figure 8:
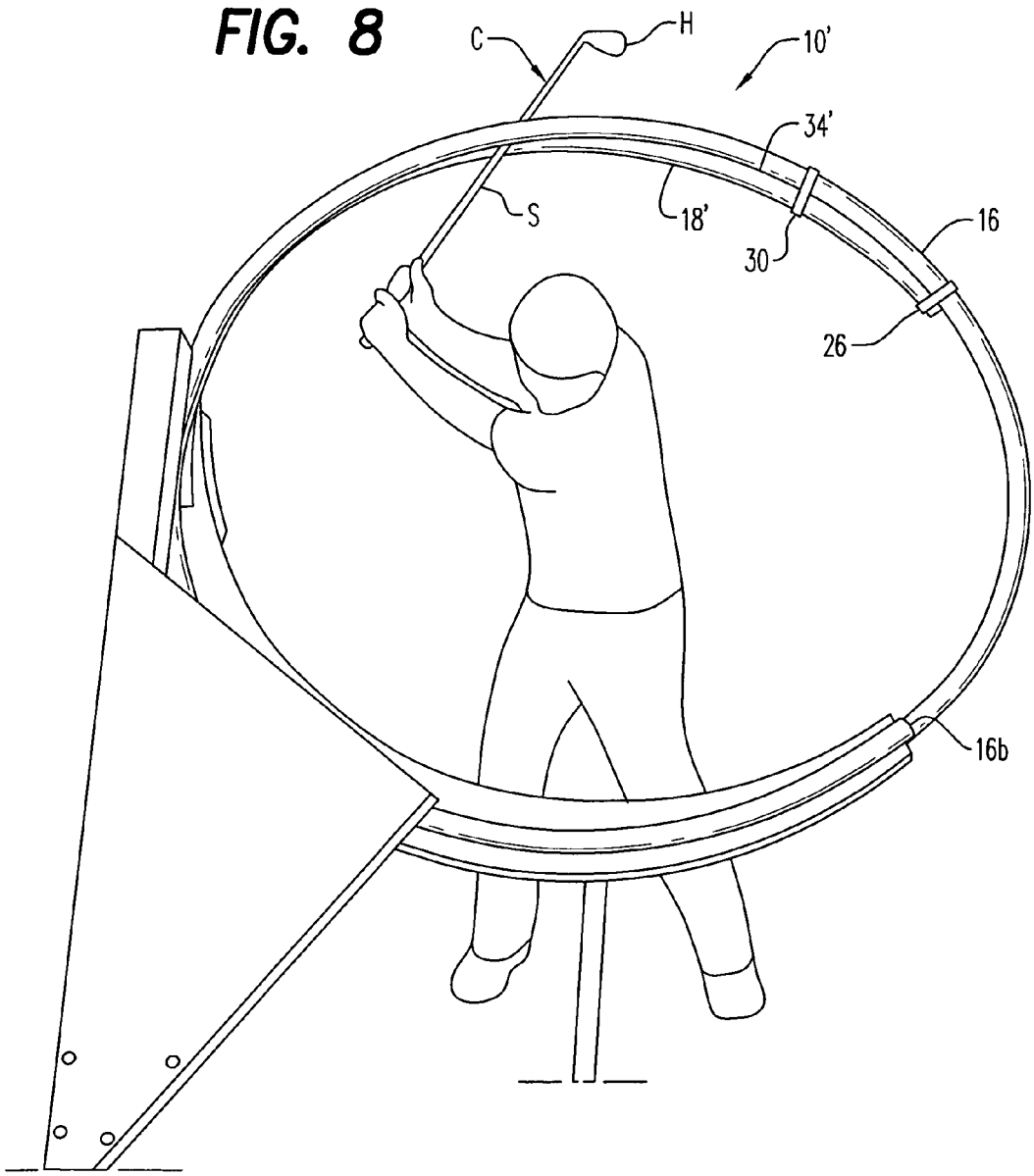
FIG. 8 is another view of FIG. 5 shown during a backstroke of a golf club.

However, the connector 26 is oriented as best seen in FIG. 1 and referencing FIG. 8 at an arcuate point well beyond the end of the normal back swing of a golf club. To allow the golfer to be advised of where he wishes to or actually does terminate the back swing, a frictionally slidable back swing stop 30 is also interconnected between the front and back guide ring segments 16 and 18 and is slidably movable back and forth in the direction of arrow A in FIG. 1. By slidably positioning this back swing stop 30 selectively along and between the front and back guide ring segments 16 and 18, a back swing termination point of the swing slot 34 is established. Thus, during back swing practice, the shaft of the golf club will contact this back swing stop 30 to advise the golfer that the back swing has extended to a desired point and/or to facilitate observing any variation in the extent of movement of the back swing, stop 30 after the practice swing is made. That is, the swing stop 30 may be tightly secured or made frictionally slidable to serve as a back swing stop or as a back swing indicator.

By selecting the material of the front and rear guide ring segments 16 and 18 to be tubular PVC plastic material, and by having established the swing slot 34 to be completely open and unobstructed, only slight contact of the golf club shaft against either of the facing surfaces of the tubular front or rear guide ring segments 16 and 18 is typically made to advise the golfer of the contact and to prevent the golf club from being swung out of the plane established by the narrow swing slot 34. The relatively low drag of the golf club shaft against the PVC material is very slight and does not inhibit in any substantial way the free swing of the golf club within the swing slot 34 while simultaneously preventing the golf club from being swung out of the plane of the swing slot 34.

Figure 5:
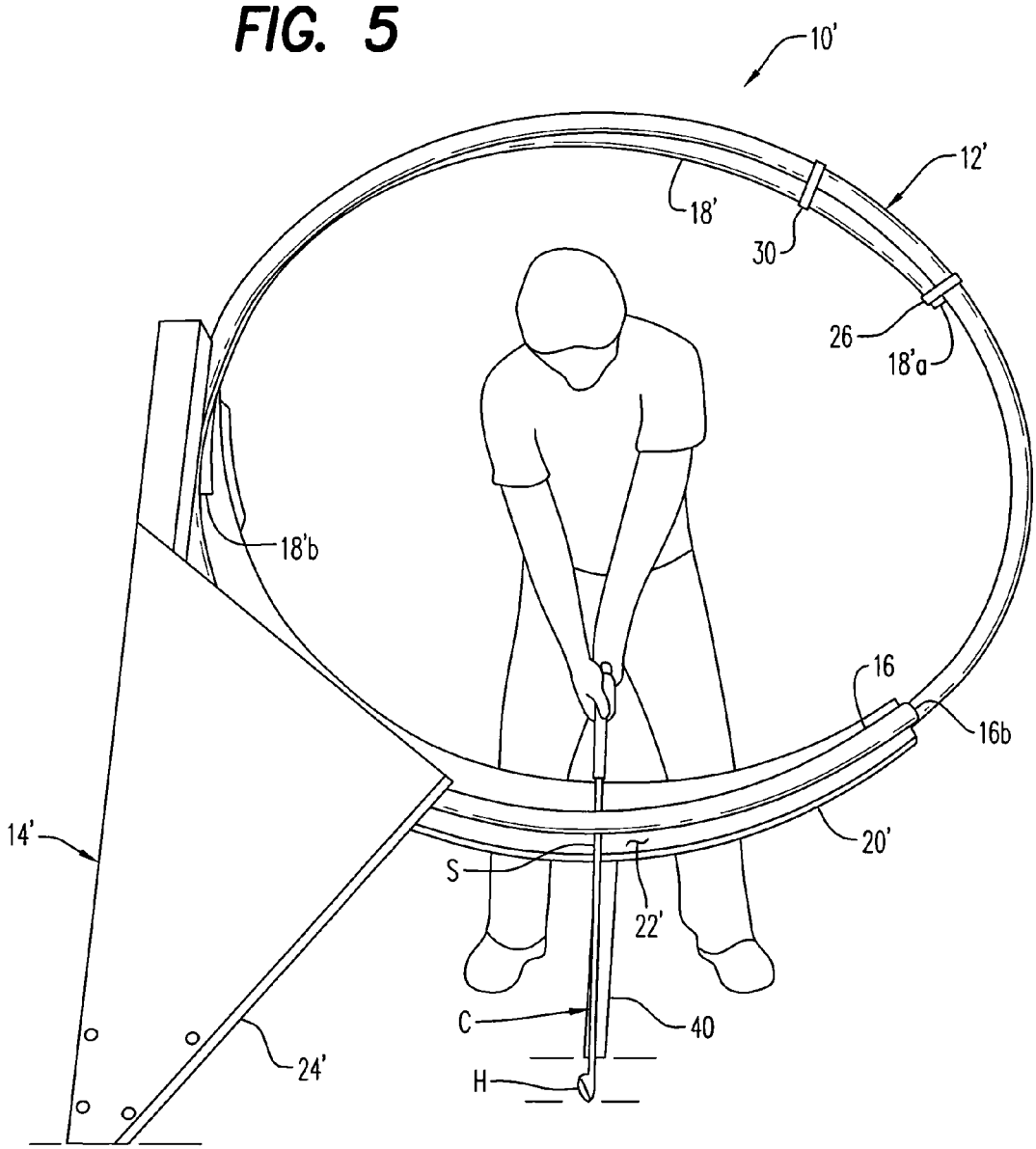
FIG. 5 is a front elevation view of another embodiment of the invention shown in use at the start of a golf swing.

Importantly, note that by embedding the proximal end 18*b* of the rear guide ring segment 18 into the pocket 42 formed into the upper end of the arcuately formed club shaft guide 20, a smooth uninterrupted surface is maintained between the inner surface of the rear guide ring 18 and the planar surface 22 of the club shaft guide 20. Further, by providing the flat or planar inclined surface 22, the shaft of the golf club will rest thereagainst to establish the proper inclined angle which matches the lie of the club being swung. Thereafter, the golfer may then more accurately position himself and his foot stance centrally both fore and aft and laterally within the open area of the golf club guide assembly 12 as shown in FIG. 5.

For taller golfers, the proximal end 16*a* of the front guide ring segment 16 may be slidably adjusted in the direction of arrow E in FIG. 1 so as to enlarge the golf swing guide assembly 12. Frictional engagement within the lower end of the club shaft guide 20 will maintain any selected positioning of the proximal end 16*a*.

Figure 2A:
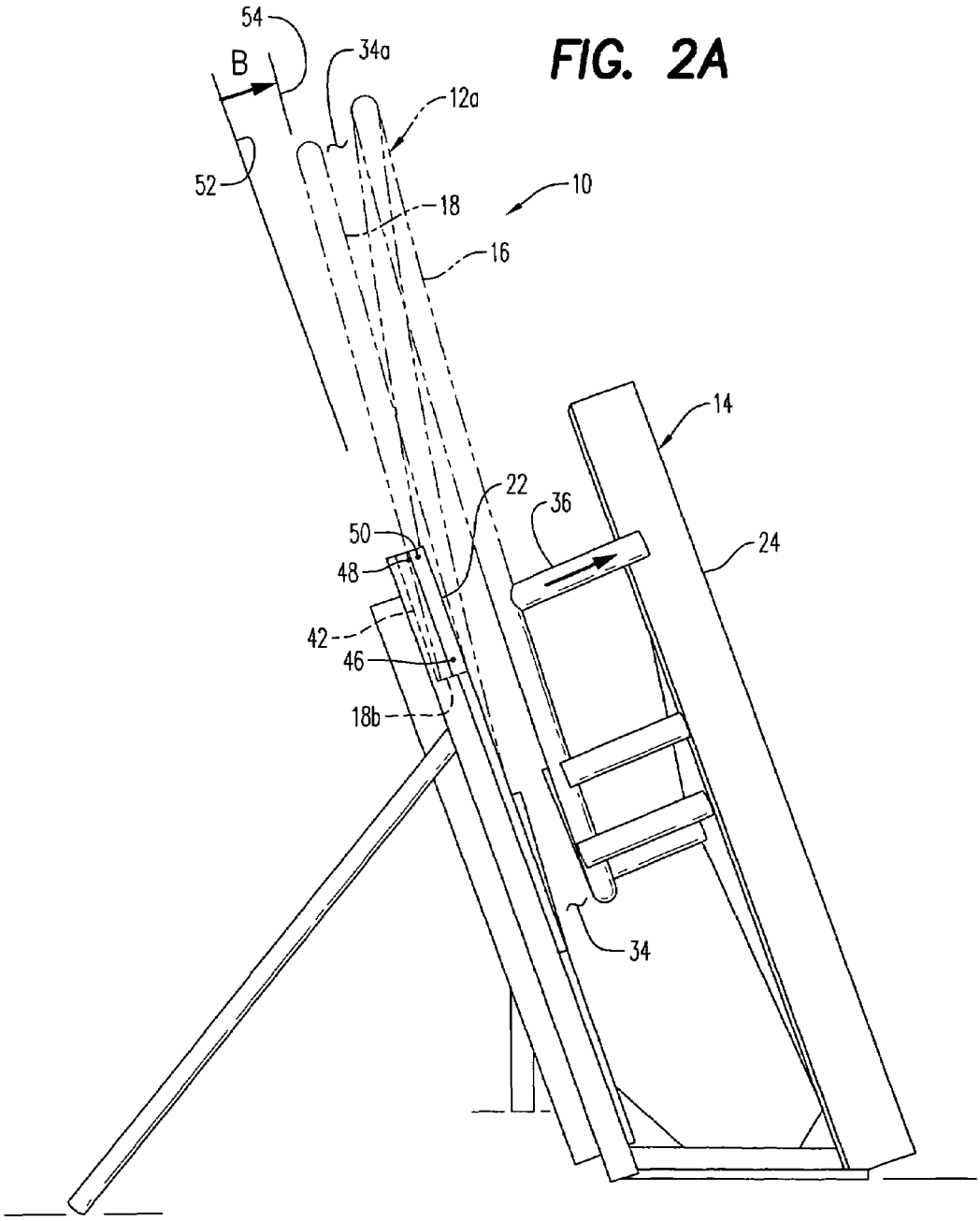
FIG. 2A is a modificating manipulation of the apparatus shown in on of FIG. 2 showing the reorientation of the upper portion of the golf club guide shown in phantom.
Figure 3:
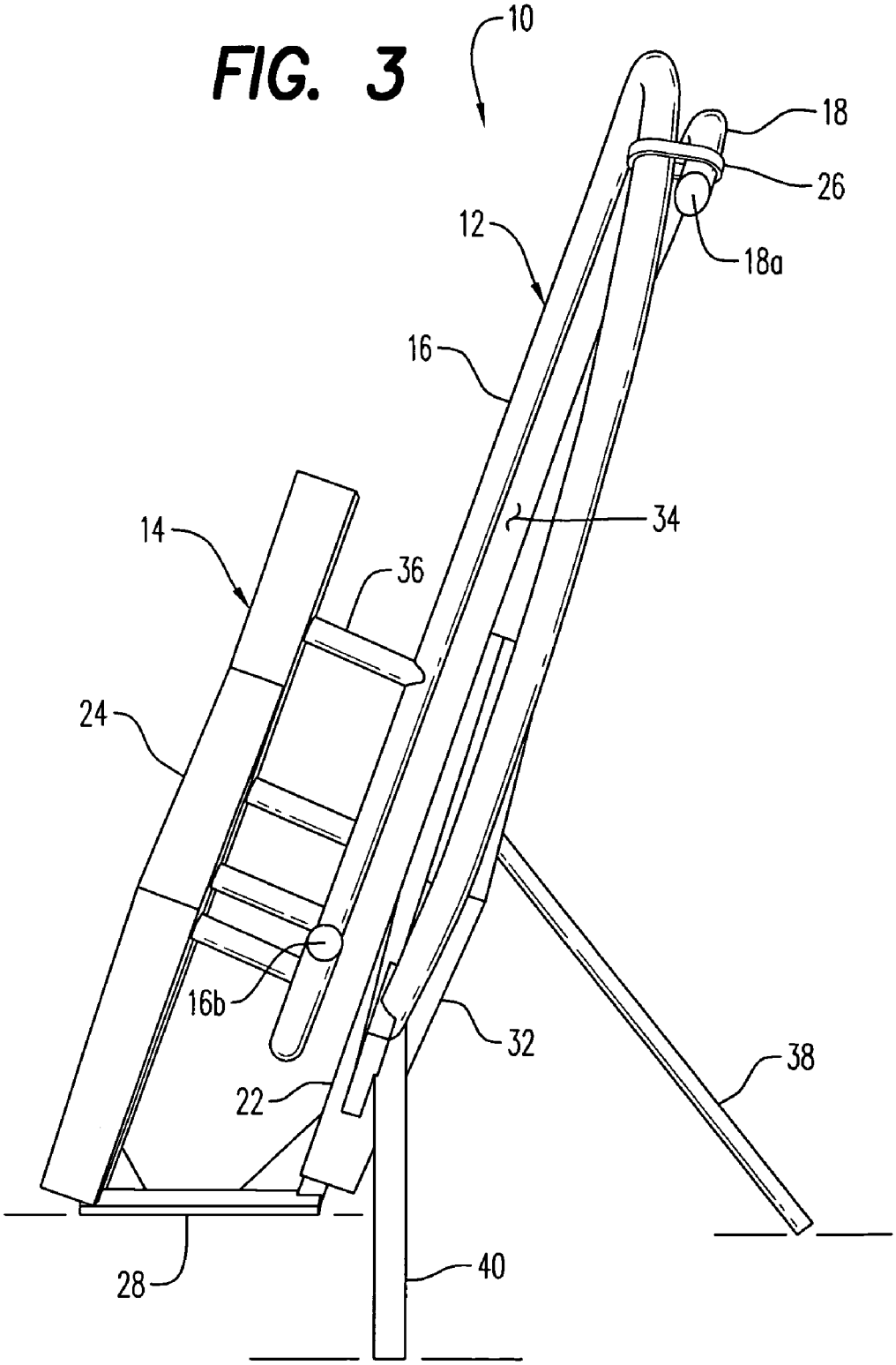
FIG. 3 is a right side elevation view of FIG. 1.

The current level of sophisticated golf swing form has incorporated a golf swing which takes the shape of two separate planar movements, the back swing lying in a plane which is more upright or at a higher lie angle than that of the down swing and follow-thru. Referring to FIG. 2A, the training of this improvement in golf club swing form is accommodated by the forwardly reorientation of the upper portions of the golf club guide assembly 12*a* shown in phantom. This is accomplished by upper pivotal movement of the upper portion of the guide assembly 12*a* and in the direction of arrow B about a lower anchor pin 46 by this repositioning an upper anchor pin 48 to a forwardly anchor pin location at 50. This reestablishes the upper plane of the swing slot 34*a* from plane 52 into a forwardly plane 54 while the lower portion of the golf club swing guide assembly 12 is maintained within plane 52 as accommodated by the flexible nature of the PVC tubing used to form the front and rear guide ring segments 16 and 18.

As shown in FIGS. 2 and 4, short lengths of 1½" o.d. aluminum reinforcing tubing are added at 56 and 58, respectively for strength and form. The tubing 58 extends from 16*b* to 60 while tubing 56 extends as shown in hidden lines within the respective portions of the rear and front guide ring segments 18 and 16.

Referring now to FIGS. 5 to 9, another and preferred embodiment of the invention is there shown generally at numeral 10' and also includes a golf club guide assembly 12' and a support frame assembly 14', both being substantially similar to that previously described. In these figures, a golfer is also shown during various stages of a practice golf swing starting with the positioning of the golf club C such that the shaft S is positioned in the plane of the planar surface 22' of the golf club guide 20 and the swing slot 34'. With the head H of the club C resting atop the ground at the lie angle D of the club C with the shaft S laying flatly against the planar surface 22, the golfer may then properly position the feet centrally both fore and aft and laterally within the opening of the golf club guide assembly 12 as shown.

Figure 6:
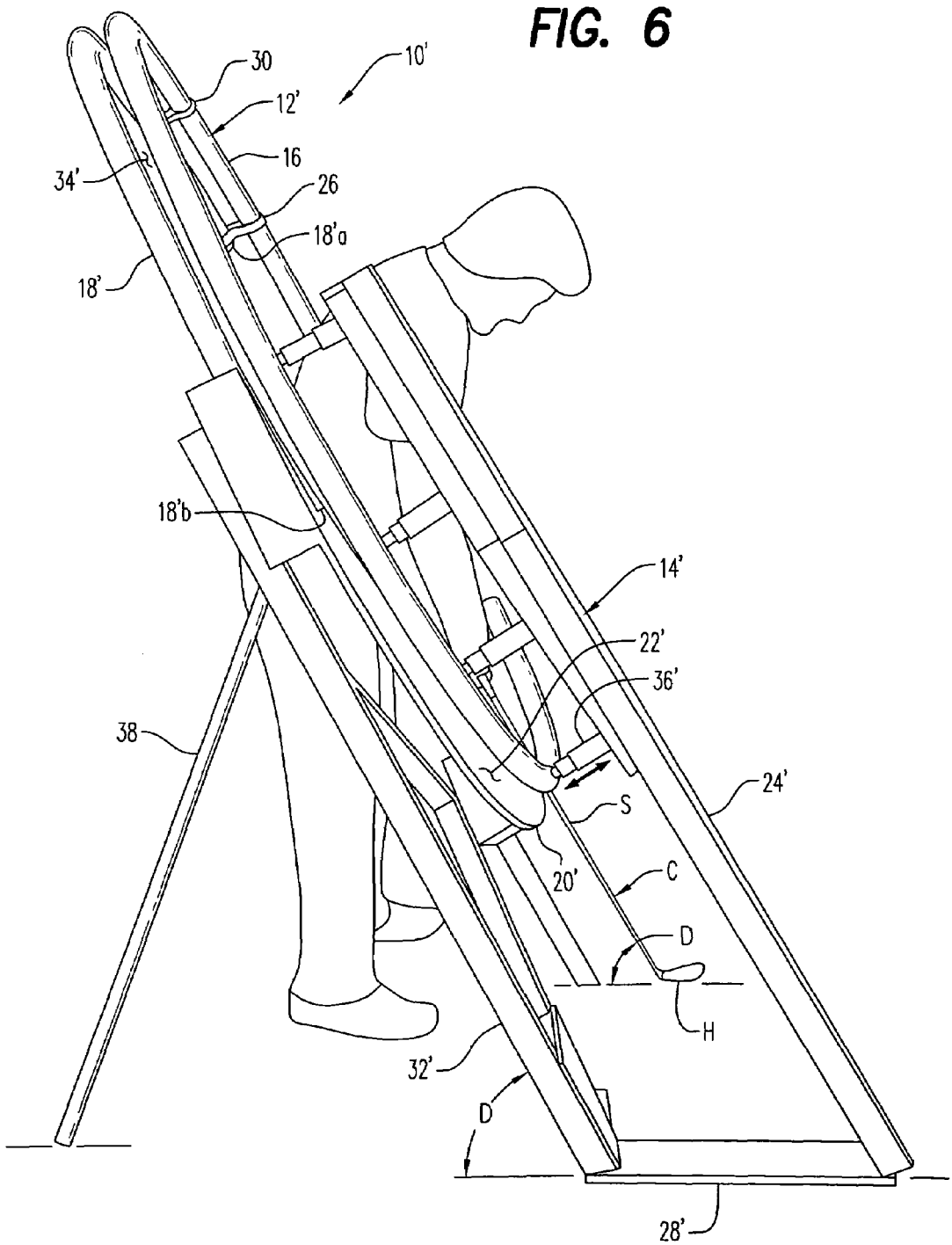
FIG. 6 is a right side elevation view of FIG. 5.
Figure 7:
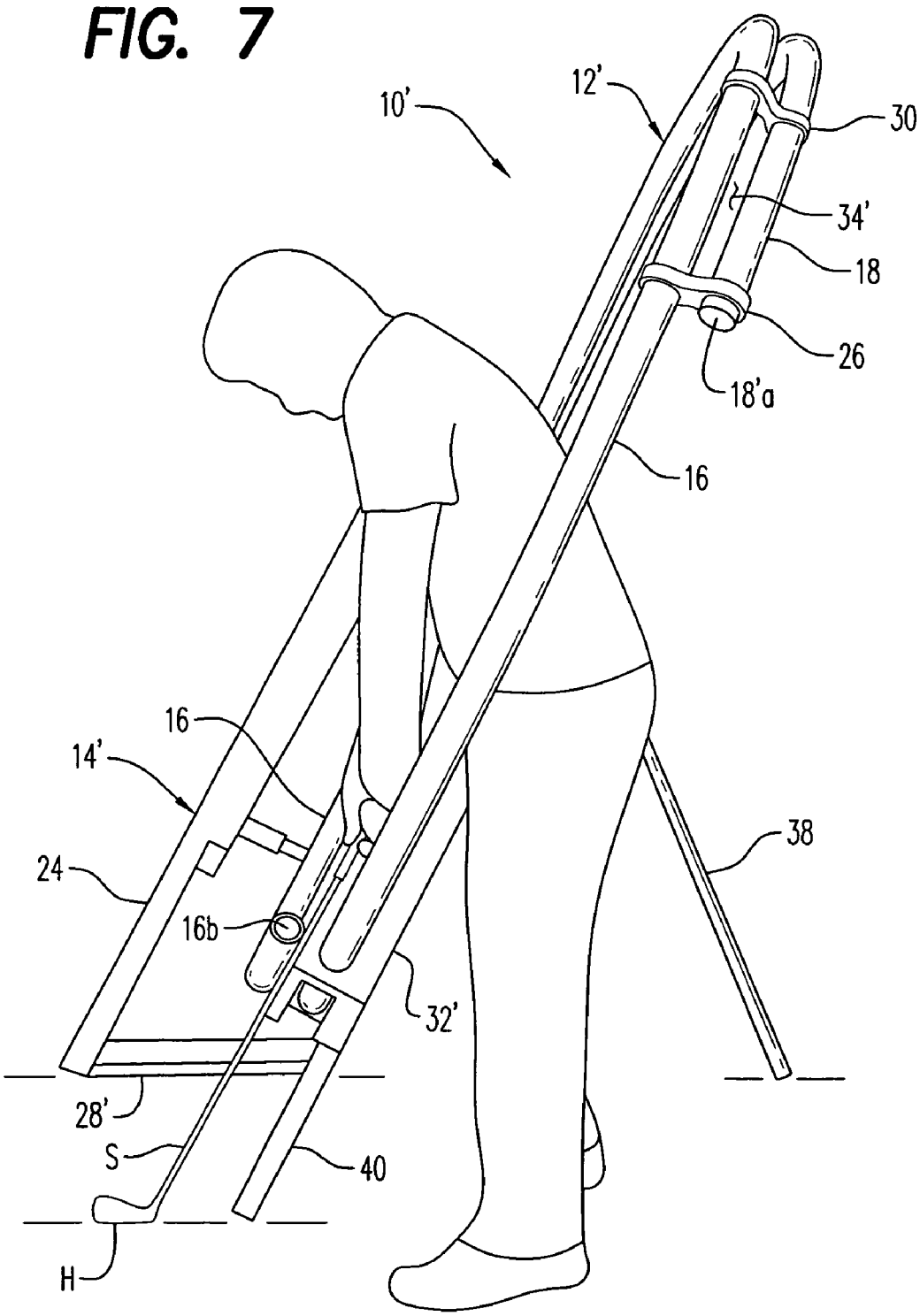
FIG. 7 is a left side elevation view of FIG. 5.

In FIGS. 5, 6 and 7, note that the golf club C is shown centered ready to begin the back swing which extends in FIG. 8 within the golf swing slot 34' up to near the top of the swing slot. Further note that the slidable back swing stop 30 is positioned beyond the end of the back swing and could be moved closer to the top of the golf club guide assembly 12'.

Figure 9:
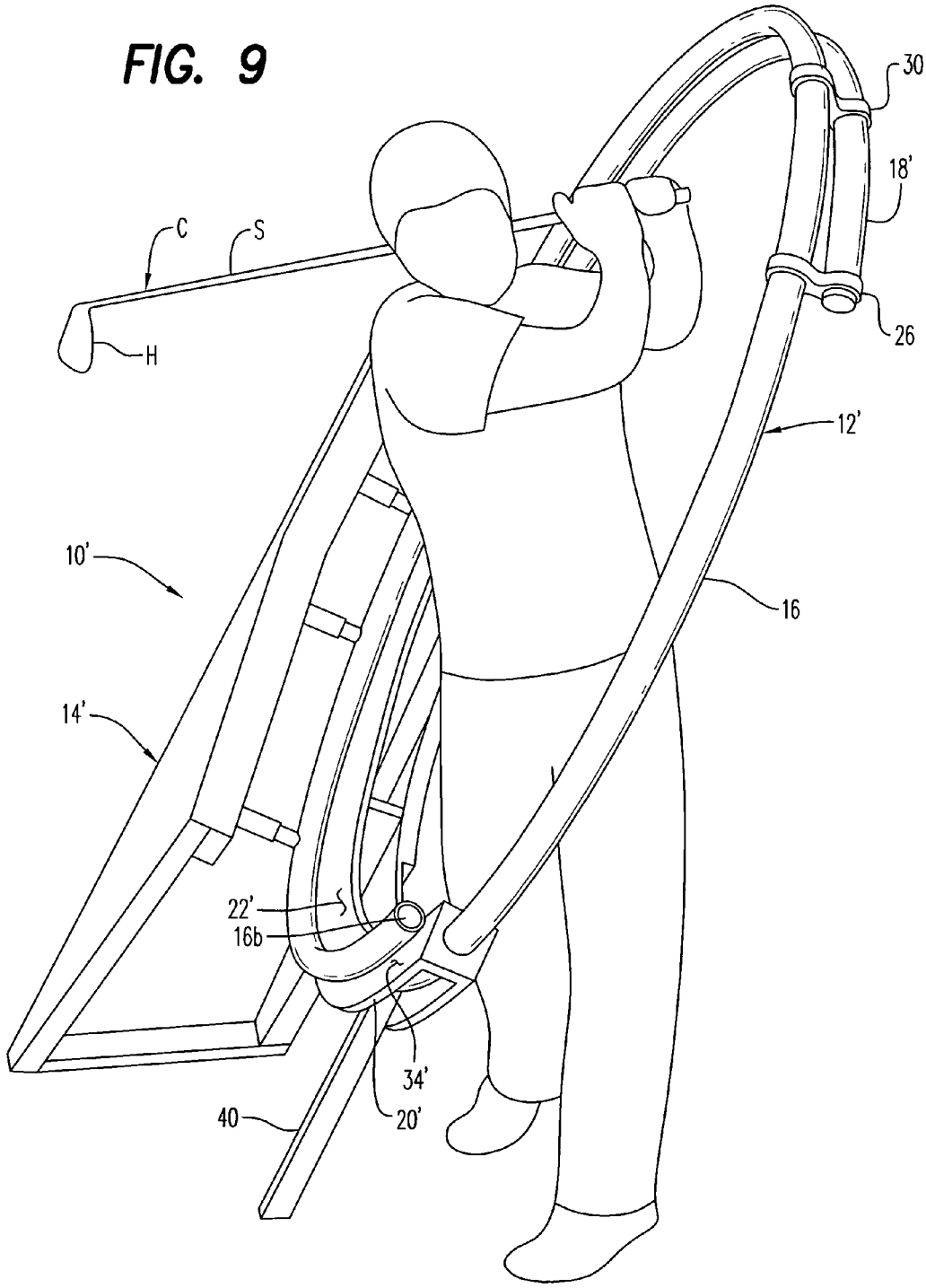
FIG. 9 is a right perspective view of FIG. 5 at the end of a golf club swing.

An important aspect of the invention is shown in FIG. 9 wherein the follow-thru portion of the swing departs from movement within the plane defined by the swing slot 34'. This departure typically begins to occur just beyond the distal end 16*b* of the front guide ring segment 16. Thus, the golf club C is allowed to be freely swung up to the top of the back swing or in proximity to the placement of the back swing stop 30 downwardly through the beginning of the follow-thru portion of the swing at 16*b* or through approximately ⅔ of a full 360° arch. Thereafter, the remainder of the follow thru part of the golf stroke is completely free of guiding interference by the apparatus 10'.

Note that, in this series of figures, the adjustable front guide ring holders 36' have been adjustably extended and locked to narrow the swing slot 34' to accommodate a greater skill of the golfer who has a more consistent uniform swing and is much less likely to make contact with the shaft S of the golf club C with any portion of the golf club guide assembly 12'.

Figure 10:
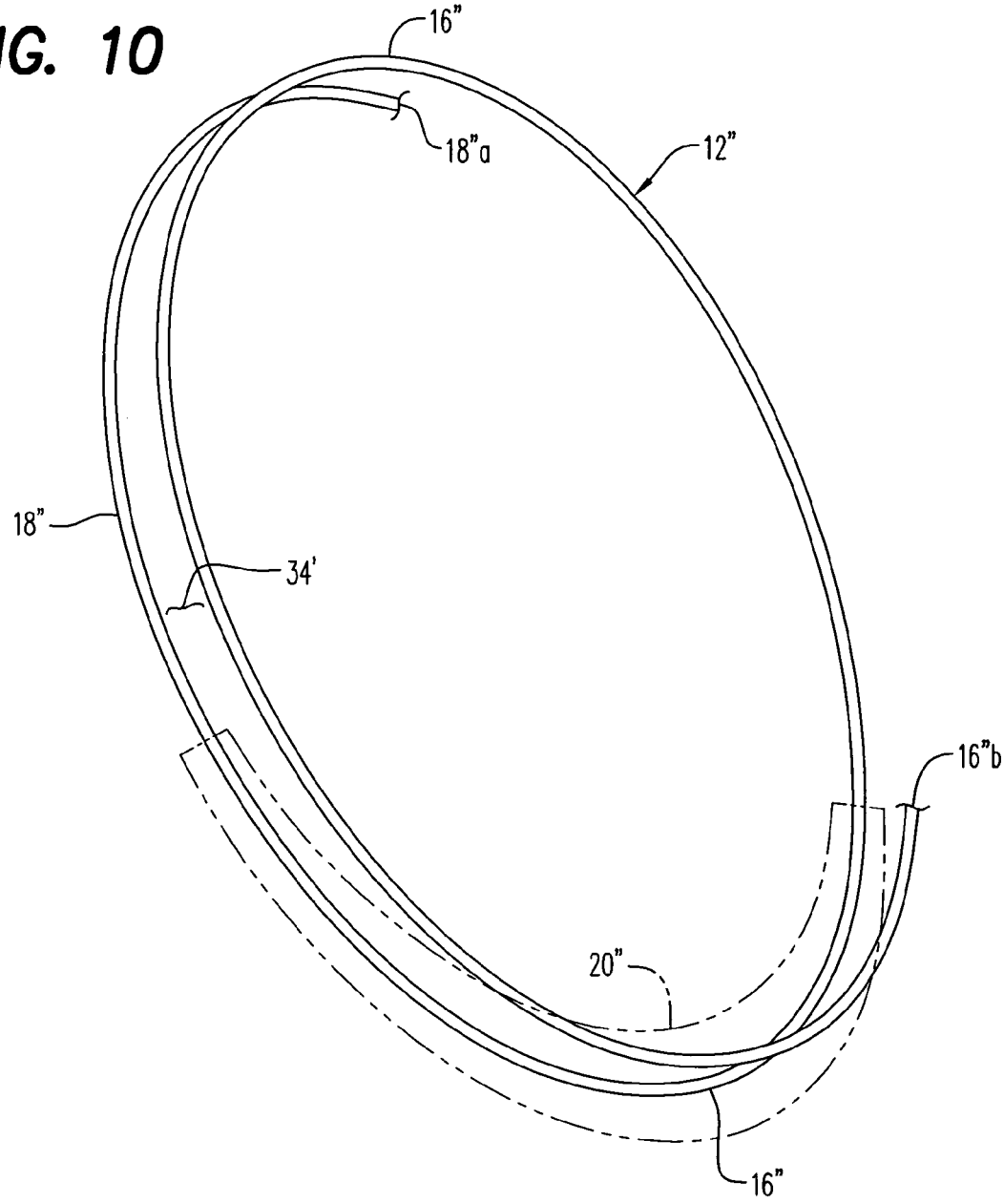
FIG. 10 is a simplistic perspective view of still another embodiment of the invention.

Referring now to FIG. 10, a schematic drawing of a third embodiment of the golf club guide assembly 12" is there shown absent the support frame assembly for clarity. In this embodiment 12", the front and rear guide ring segments 16" and 18" are formed preferably of a single length of 1½" i.d. PVC tubing spiral wound beginning at 16"*b* and terminating at 18"*a*. The flat club shaft guide 20" is incorporated and shown in phantom again for simplicity supporting the lower rear segment of the front guide ring 16". The swing slot 34' is thus formed between the spiral wound golf club guide assembly 12" which is turned through an arcuate angle of approximately 1½ turns or about 430° to 450° to define about 250° to 270° of arcuate length of the swing slot 34'.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A golf swing training apparatus, comprising:

a golf club guide;

a generally U-shaped support frame having spaced apart front and rear frame members connected together by a base frame member, said support frame being inclined to the ground or a working support surface by a support arm;

said golf club guide being positioned between said front and rear frame members and including closely spaced apart front and rear guide ring segments which define a substantially planar circular shaped golf club swing slot therebetween, said swing slot being adjustably positionable by said support arm at an inclined angle substantially equal to a lie angle of a golf club and having an unobstructed width adapted to freely swing the golf club therewithin;

said front guide ring segment being attached to and supported by said front frame members, said rear guide ring segment being attached to and supported by said rear frame member;

a substantially flat club shaft guide forming or attached to a lower portion of, and lying in a plane defined by said rear guide ring segment, said club shaft guide being adapted for supporting alignment of a shaft of a golf club at a lie angle of the golf club when the head of the golf club is resting atop the ground or working support surface.

2. A golf swing training apparatus as set forth in claim 1, wherein:

said front and rear guide ring segments are enlargeable to accommodate a taller golfer.

3. A golf swing training apparatus as set forth in claim 1, further comprising:

a back swing stop frictionally slidably attached between said front and rear guide ring segments and being positionable and adapted to provide a felt indicia against the golf club shaft of the sufficiency of a back swing of the golf club.

4. A golf swing training apparatus as set forth in claim 1, wherein:

the width of said swing slot is adjustable.

5. A golf swing training apparatus as set forth in claim 1, wherein:

upper portions of said front and rear guide ring segments are forwardly movable to define another inclined angle larger than the lie of the golf club.

6. A golf swing training apparatus, comprising:

a golf club guide;

a generally U-shaped support frame having spaced apart front and rear frame members connected together by a base frame member, said support frame being adjustably inclined to the ground or a working support surface at an inclined angle equal to the lie of a golf club by a support arm;

said golf club guide being positioned between said front and rear frame members and formed of a spiral-formed tubular member defining a guide ring of at least 1½ turns to define a substantially planar circular shaped golf club swing slot, said swing slot having an unobstructed width adapted to freely swing a golf club therewithin;

a substantially flat club shaft guide forming or attached to a lower portion of, and lying in a plane defined by, a rear segment of said guide ring, said club shaft guide being adapted for supporting alignment of a shaft of a golf club at the lie angle when the head of the golf club is resting atop the ground or working support surface.

7. A golf swing training apparatus as set forth in claim 6, wherein:

said guide ring being enlargeable to accommodate a taller golfer.

8. A golf swing training apparatus as set forth in claim 6, further comprising:

a back swing stop frictionally slidably attached between a front and rear upper segment of said guide ring and being adapted to provide a felt indicia against the golf club shaft that a back swing of the golf club is proper.

9. A golf swing training apparatus as set forth in claim 6, wherein:

the width of said swing slot is adjustable.

10. A golf swing training apparatus as set forth in claim 6, wherein:

an upper portion of said guide ring is forwardly movable to define another inclined angle which is larger than the lie angle of the golf club.

* * * * *